US008179226B2

(12) United States Patent
Ryu et al.

(10) Patent No.: US 8,179,226 B2
(45) Date of Patent: May 15, 2012

(54) ARRAY TYPE CHIP RESISTOR

(75) Inventors: Heung Bok Ryu, Gyeonggi-do (KR); Jang Ho Park, Gyeonggi-do (KR); Young Key Kim, Gyeonggi-do (KR); Ki Won Suh, Gyeonggi-do (KR); Yun Gab Choi, Seoul (KR)

(73) Assignee: Samsung Electro-Mechanics Co., Ltd., Gyunggi-Do (KR)

( * ) Notice: Subject to any disclaimer, the term of this patent is extended or adjusted under 35 U.S.C. 154(b) by 240 days.

(21) Appl. No.: 12/627,111

(22) Filed: Nov. 30, 2009

(65) Prior Publication Data

US 2011/0057767 A1 Mar. 10, 2011

(30) Foreign Application Priority Data

Sep. 4, 2009 (KR) ..... 10-2009-0083519
Sep. 4, 2009 (KR) ..... 10-2009-0083521

(51) Int. Cl.
*H01C 1/012* (2006.01)

(52) U.S. Cl. ..... 338/309; 338/332; 338/327; 257/730; 257/698

(58) Field of Classification Search ..... 338/307–309, 338/332, 323, 327; 361/770, 882; 257/730, 257/698, 774, 786
See application file for complete search history.

(56) References Cited

U.S. PATENT DOCUMENTS 4,486,738 A * 12/1984 Sadlo et al. ..... 338/320
5,285,184 A * 2/1994 Hatta et al. ..... 338/313
5,334,968 A * 8/1994 Negoro ..... 338/320
5,844,468 A * 12/1998 Doi et al. ..... 338/260
5,907,274 A * 5/1999 Kimura et al. ..... 338/309
6,005,474 A * 12/1999 Takeuchi et al. ..... 338/320
6,150,920 A * 11/2000 Hashimoto et al. ..... 338/309
6,304,167 B1 * 10/2001 Nakayama ..... 338/195
6,563,214 B2 * 5/2003 Yamada et al. ..... 257/730

(Continued)

FOREIGN PATENT DOCUMENTS

JP 05-335117 A 12/1993

(Continued)

OTHER PUBLICATIONS

Korean Notice of Allowance issued in Korean Patent Application No. 10-2009-0083521, dated Jul. 20, 2011.

(Continued)

*Primary Examiner* — Kyung Lee
(74) *Attorney, Agent, or Firm* — McDermott Will & Emery LLP

(57) ABSTRACT

The present invention provides an array type chip resistor including: a substrate formed in a rectangular parallelepiped shape; lower electrodes disposed on both sides of a bottom surface of the substrate at equal spaces; side electrodes extended from some of lower electrodes, formed on outermost edges of both sides of the substrate, in all lower electrodes, to a side surface of the substrate; a resistive element interposed between lower electrodes of the bottom surface of the substrate; a protection layer covered on the resistive element, the protection layer having both sides which cover a part of the lower electrodes and the resistive element; leveling electrodes being in contact with the lower electrodes exposed to outside of the protection layer; and a plating layer formed on the leveling electrodes. The array type chip resistor can prevent the resistive element from being damaged due to external impact when mounted since the resistive element is printed inside of the lower electrodes of the bottom surface of the substrate.

17 Claims, 6 Drawing Sheets

U.S. PATENT DOCUMENTS 6,856,234 B2 * 2/2005 Kuriyama et al. ..... 338/309

FOREIGN PATENT DOCUMENTS

| | | | |
|---|---|---|---|
| JP | 2004-134559 | A | 4/2004 |
| JP | 2006-054398 | A | 2/2006 |
| JP | 2006-186064 | | 7/2006 |
| JP | 2007-053135 | A | 3/2007 |

OTHER PUBLICATIONS

Korean Notice of Allowance issued in Korean Patent Application No. 10-2009-0083519, dated Jul. 20, 2011.

Korean Office Action issued in Korean Patent Application No. 10-2009-0083519, dated Feb. 8, 2011.

* cited by examiner

[FIG. 1]
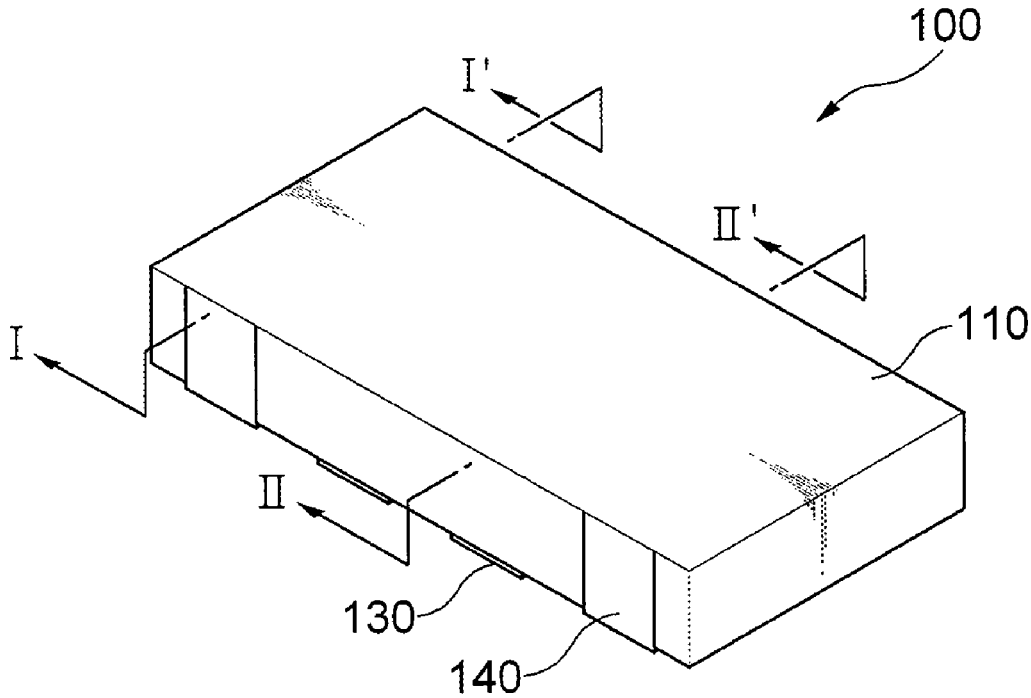
[FIG. 2]
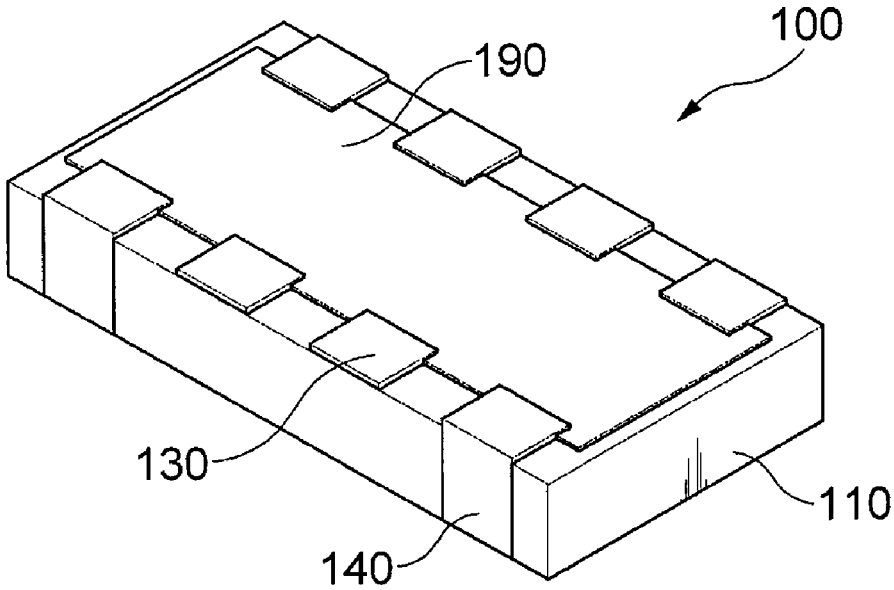

[FIG. 3]
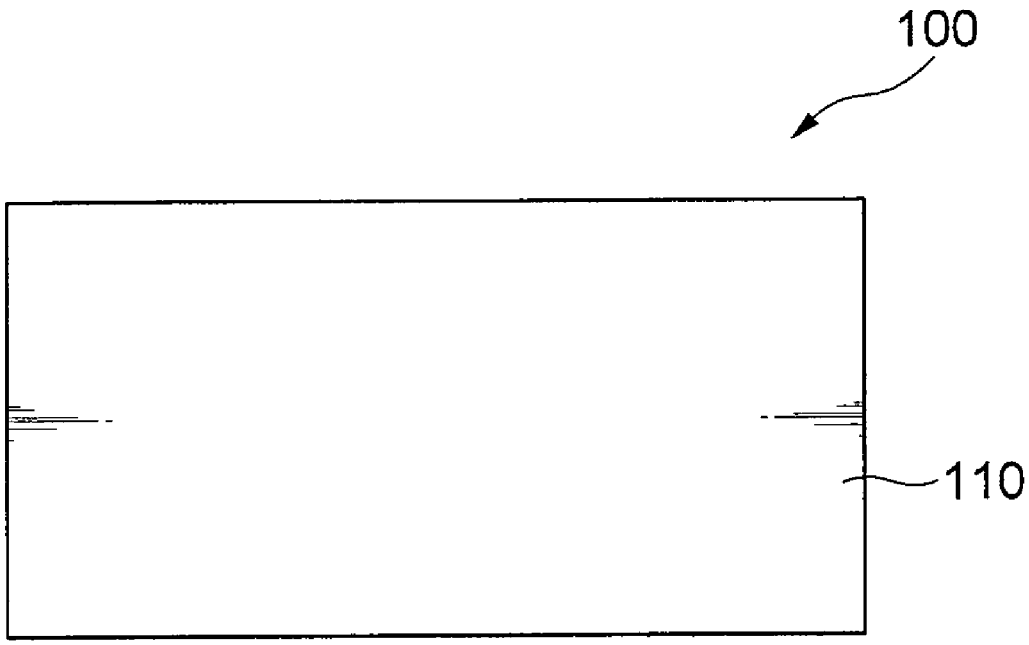
[FIG. 4]
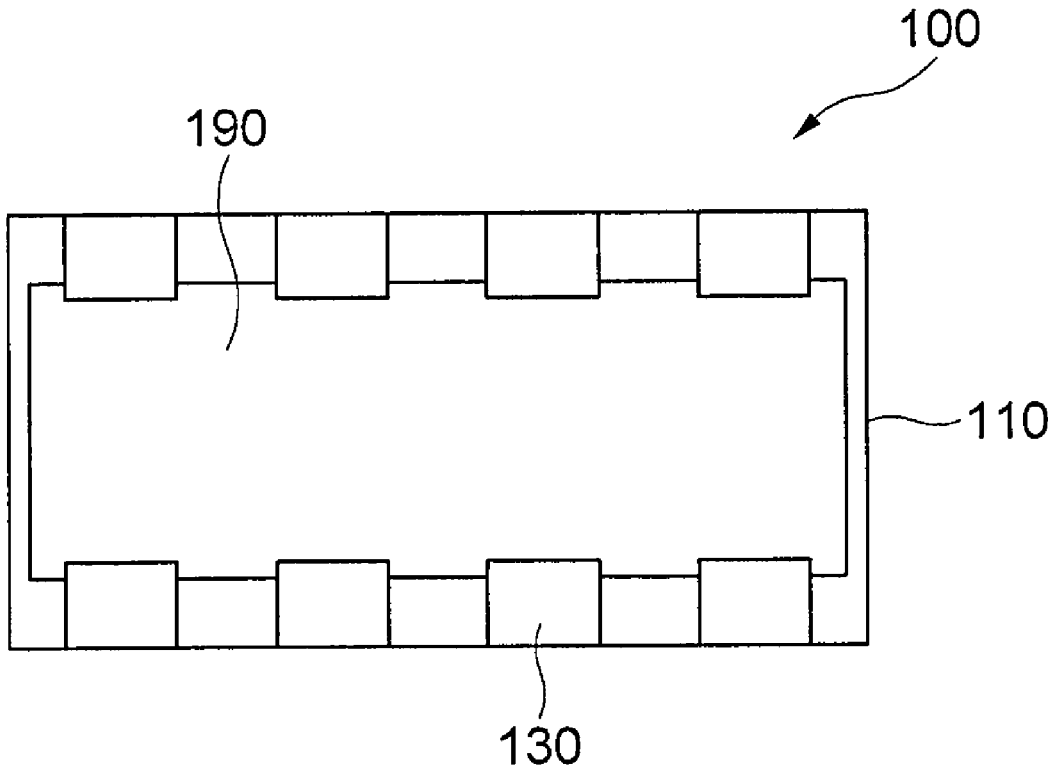

[FIG. 5A]
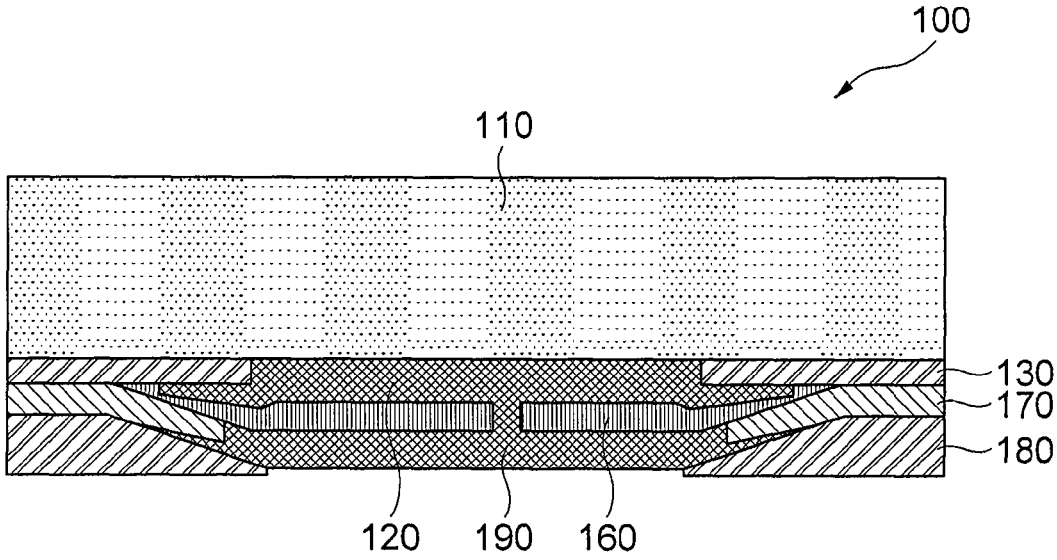
[FIG. 5B]
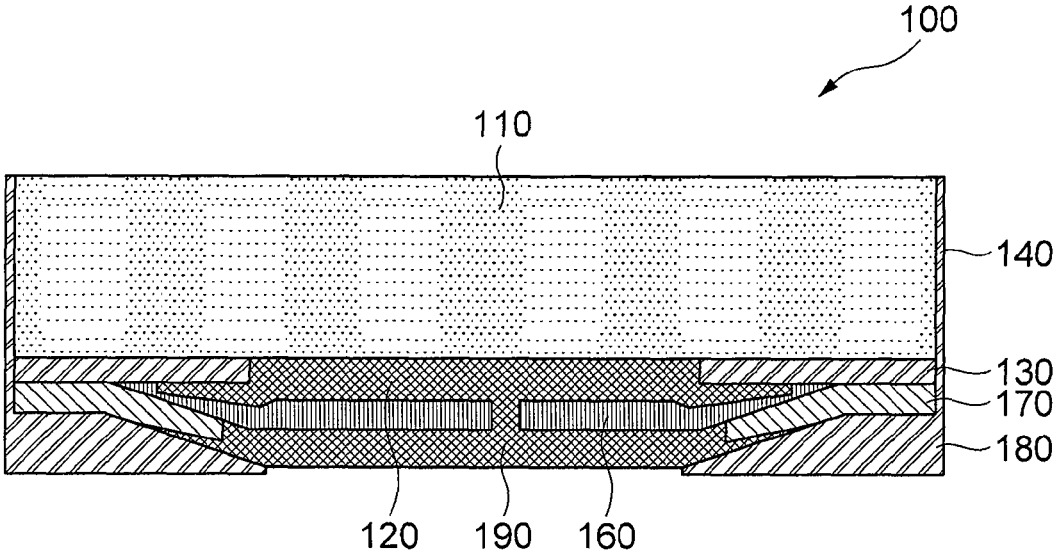

[FIG. 6]
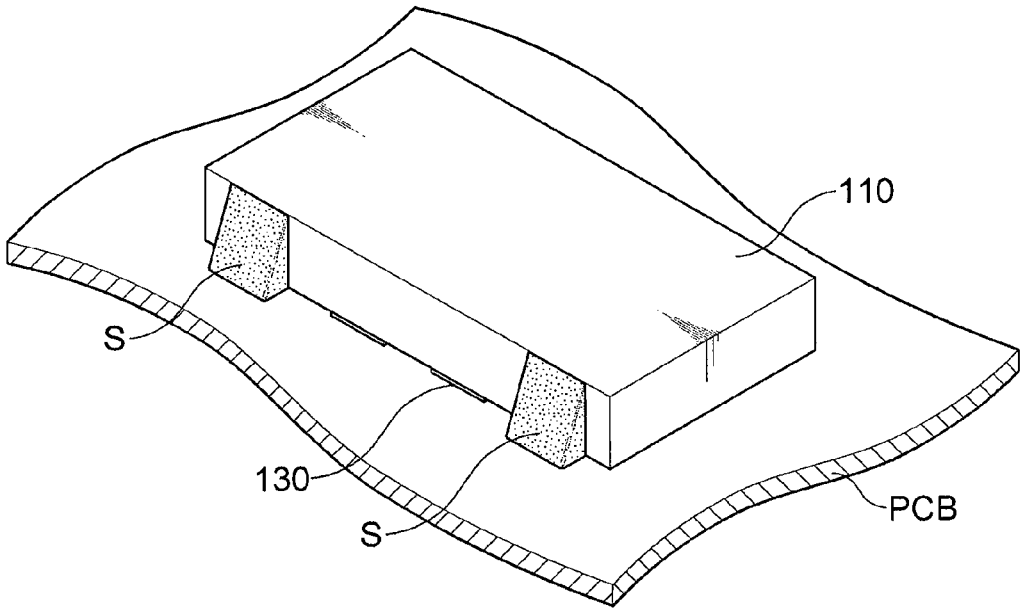
[FIG. 7]
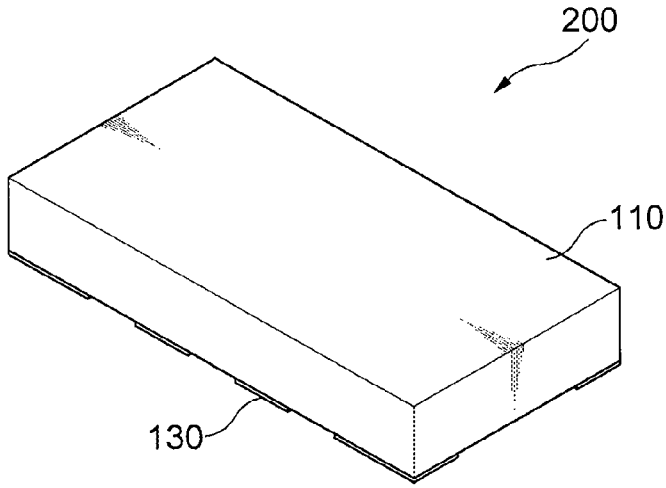

[FIG. 8]
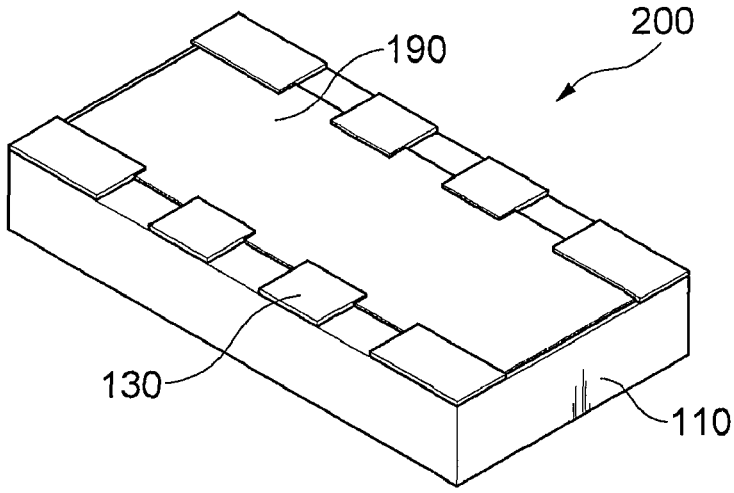
[FIG. 9]
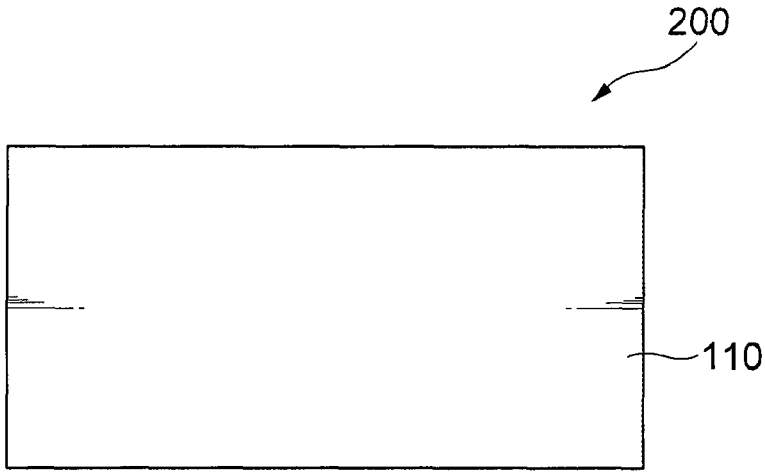
[FIG. 10]
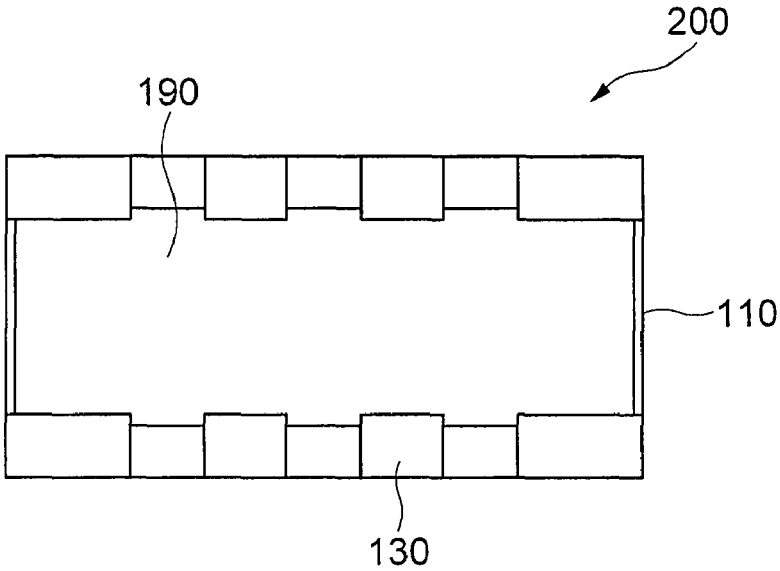

[FIG. 11]
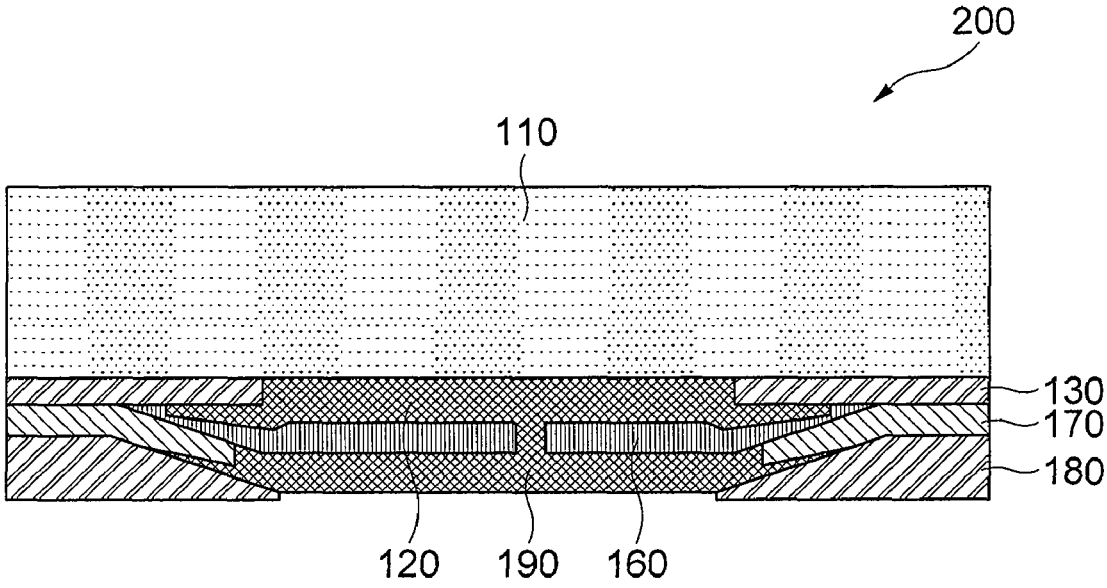

ARRAY TYPE CHIP RESISTOR

CROSS-REFERENCE TO RELATED APPLICATIONS

This application claims the benefit of Korean Patent Application Nos. 10-2009-0083519 and 10-2009-0083521 filed with the Korea Intellectual Property Office on Sep. 4, 2009, the disclosures of which are incorporated herein by references.

BACKGROUND OF THE INVENTION

1. Field of the Invention

The present invention relates to an array type chip resistor; and, more particularly, to an array type chip resistor, in which a resistor element is disposed below a substrate so that the resistor element can be prevented from being damaged due to external impact.

2. Description of the Related Art

In general, a chip resistor refers to a resistor manufactured in a semiconductor package type by mounting a number of resistors into one body so as to increase a degree of integration of electronic products.

Such a chip resistor is mostly mounted on a semiconductor module. The sizes of personal computers (PC) and servers gradually become small, but there is a limit in downsizing the semiconductor module mounted on the PCs or servers, e.g., memory module.

Therefore, an array type chip resistor integrally configured with a number of resistive elements so as to increase a degree of its integration has been used as the chip resistor mounted on the memory module.

The array type chip resistor has been mostly used in order to reduce noises of signal waves reflected in a semiconductor package on which a memory module is mounted. However, it have been pointed out that the conventional chip resistor has a variety of quality problems due to external environment when mounted on a printed circuit board.

That is, the conventional chip resistor includes a substrate, a resistive element formed on a top surface of the substrate, an external electrode which is connected to the resistive element and is extended from the top surface to side and top surfaces thereof. In this case, the external electrode, which is made of a conductor's terminal, is used as an electrical connection means when the chip resistor is mounted on a PCB.

When mounted on a PCB or moved for mounting, the conventional chip resistor has problems of damages of the substrate and corners thereof due to external impact by worker's carelessness. Further, when external impact is applied to the resistive element exposed to the top surface of the substrate during mounting, the resistive element may be damaged.

In the conventional chip resistor, there may be produced scratch phenomenon that peels coating materials of an external electrode printed on side surfaces thereof due to external friction or contact between chip resistors. Further, there may be also produced short between electrodes due to the scratch phenomenon when soldering is performed for mounting the chip resistor.

Meanwhile, a bearing layer is formed between each electrode at the time of forming an upper electrode connected to the resistive element in order to prevent short of electrodes resulting from scratch of an external electrode in the chip resistor. However, the bearing layer is insufficient for prevention of electrode short.

SUMMARY OF THE INVENTION

The present invention has been proposed in order to overcome the above-described problems and it is, therefore, an object of the present invention to provide an array type chip resistor, in which a resistive element is disposed below a substrate so that a resistive element can be prevented from being exposed to outside when the resistive element is mounted, which results in preventing the resistive element from being damaged due to external impact.

Further, another object of the present invention is to provide an array type chip resistor which can prevent short generation due to scratch by minimizing areas of upper electrodes and side electrodes exposed to outside of the substrate.

In accordance with one aspect of the present invention to achieve the object, there is provided an array type chip resistor including: a substrate formed in a rectangular parallelepiped shape; lower electrodes disposed on both sides of a bottom surface of the substrate at equal spaces; side electrodes extended from some of lower electrodes, formed on outermost edges of both sides of the substrate, in all lower electrodes, to a side surface of the substrate; a resistive element interposed between lower electrodes of the bottom surface of the substrate; a protection layer covered on the resistive element, the protection layer having both sides which cover a part of the lower electrodes and the resistive element; leveling electrodes being in contact with the lower electrodes exposed to outside of the protection layer; and a plating layer formed on the leveling electrodes.

It is preferable that the substrate is made of alumina material insulated through an anodizing process of an aluminum's surface, and plays a role of thermal diffusion path through which heat produced from the resistive element is emitted to outside.

Also, the lower electrodes are in electrical contact with a pad formed on a main substrate when the chip resistor is mounted on the main substrate, and the side electrodes are extended from some of the lower electrodes, formed on outermost edges thereof, in all lower electrodes, i.e., some of the lower electrodes formed on both side of the substrate, to side surfaces of the substrate.

In this case, the side electrodes may be formed to have heights ranging between 50% to 100% in comparison with a height of side surface of the substrate.

Also, the protection layer may be made of a silicon material, or a glass material, and the protection layer is covered up to a part of inside of the lower electrodes exposed to both sides of the resistive element.

In this case, after the resistive element covers the protection layer, grooves formed by trimming a part of the resistive element through a laser may be formed so as to implement an accurate resistance value.

It is preferable that the leveling electrodes are for electrodes to enable lower electrodes with effective areas reduced by the protection layer to have expanded effective area, and the leveling electrodes are formed on the lower electrodes exposed to outside of the protection layer.

Also, the plating layer performs protection of the lower electrodes, as well as formation of external electrodes by growing Ni—Sn plating layer on the leveling electrodes so that it can be exposed to outside of the chip resistor.

Also, the chip resistor may further include an insulating layer which covers outside of the protection layer, and the insulating layer is made of polymer and finally protects the resistive element. Further, the insulating layer prevents plating solution from infiltrating to the resistive element when the plating layer for formation of the external electrode is formed.

In this case, it is preferable that the plating layer is formed to have a height higher than that of the insulating layer.

In accordance with another aspect of the present invention to achieve the object, there is provided an array type chip resistor including: a substrate formed in a rectangular parallelepiped shape; lower electrodes disposed on both sides of a bottom surface of the substrate at equal spaces, the lower electrodes being formed by extending electrodes disposed on both sides of the substrate up to corners of the substrate; resistive element interposed between the lower electrodes of the bottom surface of the substrate; a protection layer covered on the resistive element, the protection layer having both sides which covers a part of the lower electrodes and the resistive element; leveling electrodes being in contact with the lower electrodes exposed to outside of the protection layer; and a plating layer formed on the leveling electrodes, the plating layer having one side which is extended to be in contact with the corners of the substrate so that the plating layer is opposed to the lower electrodes extended to the corners of the substrate.

In this case, the side electrodes may be formed by expanding the lower electrodes to side surfaces of the substrate, and the side electrodes may be formed to have heights below 20% in comparison with a height of the side surface thereof when formed on the side surfaces of the substrate.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which:

FIG. 1 is a perspective view showing a chip resistor in accordance with one embodiment of the present invention;

FIG. 2 is a bottom perspective view showing a chip resistor in accordance with one embodiment of the present invention;

FIG. 3 is a plane view showing a chip resistor in accordance with one embodiment of the present invention;

FIG. 4 is a rear view showing a chip resistor in accordance with one embodiment of the present invention;

FIG. 5 is a cross-sectional view taken along I-I' and II-II' of FIG. 1;

FIG. 6 is a perspective view showing a case where the chip resistor in accordance with an embodiment of the present invention is mounted on the main substrate;

FIGS. 7 to 11 are views showing a chip resistor in accordance with other embodiment of the present invention, respectively, and FIG. 7 is a perspective view showing a chip resistor in accordance with other embodiment of the present invention;

FIG. 8 is a bottom perspective view showing a chip resistor in accordance with other embodiment of the present invention;

FIGS. 9 and 10 are a plane view and a rear view of a chip resistor in accordance with other embodiment of the present invention, respectively; and FIG. 11 is a cross-sectional view showing a case where the chip resistor in accordance with an embodiment of the present invention is mounted on the main substrate.

DETAILED DESCRIPTION OF THE PREFERABLE EMBODIMENTS

An array type chip resistor in accordance with the present invention will be described in detail with reference to the accompanying drawings. When describing them with reference to the drawings, the same or corresponding component is represented by the same reference numeral and repeated description thereof will be omitted.

FIG. 1 is a perspective view showing a chip resistor in accordance with one embodiment of the present invention. FIG. 2 is a bottom perspective view showing a chip resistor in accordance with one embodiment of the present invention. FIG. 3 is a plane view showing a chip resistor in accordance with one embodiment of the present invention. FIG. 4 is a rear view showing a chip resistor in accordance with one embodiment of the present invention. FIG. 5 is a cross-sectional view taken along I-I' and II-II' of FIG. 1.

As shown in drawings, the chip resistor 100 in accordance with one embodiment of the present invention includes a substrate 110 having a plurality of grooves formed in a rectangular parallelepiped shape, a resistive element 120 formed on a bottom surface of the substrate 110, and a plurality of lower electrodes 130 electrically connected to the resistive element 120.

The substrate 110 may be formed in a thin plate shaped like a rectangular parallelepiped, and may be formed of alumina material insulated through an anodizing process of an aluminum's surface. Further, as the substrate 110 is formed of a material with superior heat conductivity, the substrate 110 serves as thermal diffusion path through which heat produced from the resistive element 120 is emitted to outside at surface-mounting of the chip resistor 100.

A plurality of lower electrodes 130 disposed at a predetermined space are formed on both sides of the bottom surface of the substrate 110. The resistive element 120 composed of RuO as its principal ingredient is printed on a central portion of the bottom surface of the substrate 110 of inside of the lower electrodes 130. In this case, the resistive element 120, and a plurality of lower electrodes 130 disposed on an external side thereof are electrically connected to one another.

When the resistive element 120 is printed on the internal side of the lower electrodes 130 formed on both sides of the bottom surface of the substrate 110, the resistive element 120 is printed so that the lower electrodes 130 are partially covered for stably electrical connection between the resistive element 120 and the lower electrodes 130.

Also, it is preferable that the lower electrodes 130 are disposed to have the same size at equal spaces. When the chip resistor 100 is mounted on a main substrate (not shown), the lower electrodes 130 disposed at equal spaces are opposed to a pad and are electrically bonded to the pad of the main substrate through solders.

The side electrodes 140 may be extended from the lower electrodes 130 to a side surface of the substrate 110. The side electrodes 140 are extended from the lower electrodes 130, disposed on outermost edges of a bottom surface of the substrate 110, in all lower electrodes 130, that is, four lower electrodes 130 formed on corners of both sides of the substrate 110, to the side surface of the substrate 110.

In this case, it is preferable that the side electrodes 140 are formed to have heights ranging between 50% to 100%, in comparison with a height of the side surface of the substrate 110. After the lower electrodes 130 are formed, the side electrodes 140 may be formed of the same material as the lower electrodes 130 and may be extended from the lower electrodes 130. However, the side electrodes 140 may be allowed to be formed simultaneously while a plating layer to be described below is being formed for process's convenience.

When the chip resistor 100 is mounted on the main substrate, the side electrodes 140 are formed for improvement of an insufficient bonding strength when soldering is performed only for the lower electrodes 130. When soldering bonding of the chip resistor 100 is performed, side bonding of solders is made on the side electrodes 140 formed on both sides of the side surface of the substrate 110, so it is possible to improve bonding performance of the chip resistor 100.

Also, as the side electrodes 140 are disposed on both sides of the side surface of the substrate 110, even if scratch occurs in the substrate 110, it is possible to prevent short due to electrical contact between electrodes. This is because the solders can be prevented from infiltrating to adjacent electrodes bonded to the side electrodes 140.

Meanwhile, a protection layer 160 for protecting the resistive element 120 from external impact is covered on the resistive element 120 which is interposed between the lower electrodes 130 and is printed at a predetermined thickness. In this case, it is preferable that the protection layer 160 may be formed of a material composed of $SiO_2$ or glass, which may be formed on the protection layer 160 by over coating.

The protection layer 160 is formed on exposed overall surfaces of the resistive element 120 in order to protect the resistive element 120. However, it is preferable that the protection layer 160 is formed to cover not only a part of the inside of the lower electrodes 130 provided on the outside of the resistive element 120, but also the resistive element 120, in order to entirely seal the resistive element 120.

The resistive element 120 having the protection layer 160 formed thereon aims to implement resistor characteristics by interrupting a current flow through the chip resistor 100 at the time of surface mounting. In this case, the resistive element 120 is required to have an appropriate capacitance. To this end, after having the protection layer 160 formed thereon, the resistive element 120 can be implemented to have an appropriate capacitance value by performing a trimming process through a laser.

In other words, if it is assumed that the chip resistor can implement a resistance value of 100Ω, the resistive element 120 is formed to implement roughly resistance values of 80 to 90Ω because it is impossible to form the resistive element 120 having accurately a resistance value of 100Ω when the resistive element 120 is printed, and the resistive element 120 is formed to have grooves with shapes obtained by undergoing a trimming process through a laser, so that a resistance value is increased, which makes it possible to implement a resistance value of 100Ω corresponding to a deign value in the chip resistor 100.

In this case, the reason why the protection layer 160 is formed on the resistive element 120 and the resistive element 120 is formed to have trimmed grooves is that crack of the resistive element 120 is prevented by using the protection layer 160 when the trimming process is performed through a laser.

The leveling electrodes 170 being in electrical contact with the lower electrodes 130 are formed after the protection layer 160 for covering the resistive element 120 is formed. The leveling electrodes 170 may be formed on a circumference of the protection layer 160 which covers the lower electrodes 130 and a part of the lower electrodes 130. The leveling electrodes 170 play a role of enabling the electrodes to be stably contacted to one another by expanding reduced effective areas of the lower electrodes 130.

Also, the leveling electrodes 170 may be formed on the lower electrodes 130 at a predetermined height. In this case, the reason why the leveling electrodes 170 are additionally formed on the lower electrodes 130 is that a final electrode has a height higher than heights of the resistive element 120, and the insulating layer, as well as the protection layer 160, wherein the resistive element 120 is printed on the bottom surface of the substrate 110, and the insulating layer is to be described below.

That is, the leveling electrodes 170 are adjusted to have a nearly identical height of the protection layer 160 and the resistive element 120 formed on the center of the bottom surface of substrate 110. When the resistive element 120 and the protection layer 160 are formed, the leveling electrodes 170 come into contact with reduced effective areas of the lower electrodes 130 to thereby expand areas of the electrodes, which makes it possible to ensure electrode's safety and easily form a plating layer.

Meanwhile, the plating layer 180 is formed on the leveling electrodes 170 in order to form finally an external electrode. The plating layer 180 may be sequentially subjected to Ni plating and Sn plating, and the plating layer 180 may be formed through electroless plating or electro plating.

In this case, the Ni plating layer may correspond to a plating layer for protection of the leveling electrodes 170 at the time of soldering, and the Sn plating layer may be formed for solders convenient for soldering.

In addition, the chip resistor 100 may further include an insulating layer 190 which covers the entire protection layer 160 when the external electrode is formed by the plating layer 180. It is preferable that the insulating layer 190 is made of a glass material or a polymer material similar to that of the protection layer 160. The insulating layer 190 plays a role of finally protecting the resistive element 120.

Also, the insulating layer 190 protects the resistive element 120 from external impact by perfectly preventing the resistive element 120 from being exposed to the outside. Moreover, the insulating layer 190 prevents plating solution from infiltrating to the resistive element 120 when the plating layer 180 for formation of the external electrode is formed, by covering a part of the leveling electrodes 170 of being additional electrodes and all surfaces of the resistive element 120.

In this case, it is preferable that the plating layer 180 formed on both sides of the insulating layer 190 is formed to have a height higher than that of the central portion of the insulating layer 190. This is because when the chip resistor 100 is mounted on the main substrate PCB, stable mounting can be achieved. In more particular, this is because when the convex-shaped central portion of the insulating layer 190 is formed to have a height higher than that of the plating layer 180, the chip resistor 110 is prevented from being obliquely mounted on the main substrate due to a convex portion of the center of the insulating layer 190 when subjected to soldering, which refers to Tombstone defects.

FIG. 6 is a perspective view showing a case where the chip resistor in accordance with an embodiment of the present invention is mounted on the main substrate.

As shown in FIG. 6, when the chip resistor 100 is mounted on the main substrate PCB, the insulating layer 190 surrounding the lower electrodes 130 and the resistive element 120 and the plating layer 180 are allowed to come into contact with the main substrate PCB so that it is possible to prevent the resistive element 120 from being exposed to outside.

After the chip resistor 100 is mounted, the chip resistor 100 is bonded to the main substrate through soldering. Solders S fused in bonding soldering are bonded through the side electrodes 140 and the lower electrodes 130 of the chip resistor 100, as shown in FIG. 6.

In this case, the solders S are bonded on four side electrodes 140 formed on both sides of the chip resistor 100, so that it is possible to improve a bonding strength between the chip resistor 100 and the main substrate PCB.

As such, when the chip resistor 100 is bonded on the main substrate PCB, the side electrodes 140 formed on the side surface of the substrate 110 are formed to have relatively wide spaces, it is possible to prevent short between electrodes by preventing interference of solders S in advance even if an external side surface of the chip resistor 100 is scratched when the chip resistor 100 is mounted or moved.

FIGS. 7 to 11 are views showing chip resistors in accordance with other embodiment of the present invention, respectively. FIG. 7 is a perspective view showing a chip resistor in accordance with other embodiment of the present invention. FIG. 8 is a bottom perspective view showing a chip resistor in accordance with other embodiment of the present invention. FIGS. 9 and 10 are a plane view and a rear view of a chip resistor in accordance with other embodiment of the present invention, respectively. FIG. 11 is a cross-sectional view showing a chip resistor in accordance with other embodiment of the present invention.

Those components that are the same or are in correspondence are rendered the same reference numeral regardless of the figure number, and redundant explanations are omitted.

As shown in drawings, the chip resistor 100 includes a substrate 110, a resistive element 120, and a plurality of lower electrodes 130. The substrate 110 is formed in a rectangular parallelepiped, and the resistive element 120 is formed on the bottom surface of the substrate 110. The lower electrodes 130 are electrically connected to the resistive element 120, and some of the lower electrodes 130 are disposed on outer edges of the substrate 110 and are extended to corners of the substrate 110.

As the substrate 110 is made of alumina material, which is insulated through an anodizing process of aluminum's surface and have superior heat conductivity, the substrate 110 serves as thermal diffusion path through which heat produced from the resistive element 120 is emitted to outside at surface-mounting of the chip resistor 100.

A plurality of the lower electrodes 130 disposed at equal spaces are formed on the bottom surface of the substrate 110. Then, the resistive element 120 composed of RuO as its principal ingredient is printed on a central portion of the bottom surface of the substrate 110 of inside of the lower electrodes 130. In this case, the resistive element 120, and a plurality of lower electrodes 130 disposed on an external side thereof are electrically connected to one another.

Also, the lower electrodes 130 disposed on outermost edges of the bottom surface of the substrate 110, i.e., the lower electrodes 130 disposed on both sides of the bottom surface of the substrate 110 are extended to each corner of the substrate 110, and they are disposed to have the same size at equal spaces.

In other words, the four lower electrodes 130, which are formed on each corner of the bottom surface of the substrate 110, in eight lower electrodes 130 formed on the bottom surface of the substrate 110 are extended in such a manner that respective corners are in contact with one end thereof. The four lower electrodes 130 provided therewithin may be formed to have a general size.

When the chip resistor 100 is mounted on the main substrate (not shown), the lower electrodes 130 disposed at equal spaces are opposed to the pad formed on the main substrate and are electrically bonded to the pad through solders.

In this case, some of the lower electrodes 130, formed on corners of the substrate 110, in all lower electrodes 130 are formed to have a size larger than those of other lower electrodes 130, so that it is possible to maintain bonding areas of the corners of the substrate 110 to be wide, which makes it possible to constantly maintain a bonding strength of the chip resistor 100 on the main substrate.

Herein, although not shown in drawings below, side electrodes (not shown) of the substrate 110 can be formed from the lower electrodes 130. Therefore, it is possible to form side electrodes in such a manner to have a height below 20% in comparison with a height of the side surface of the substrate.

The side electrodes are allowed so that the solders are bonded toward the side surface of the substrate 110 at soldering of the substrate 110, which makes it possible to more improve a bonding strength between the substrate 110 and the main substrate.

The chip resistor 100 is not separately provided with upper electrodes and side electrodes exposed to outside of the substrate 110, so that it is possible to mount the substrate 110 on the substrate 110 only through the lower electrodes 130. Therefore, it is possible to prevent short due to electrical contact between electrodes by minimizing the solders bonded to outside of the substrate 110 even if the substrate 110 is scratched.

Meanwhile, the protection layer 160 for protecting the resistive element 120 from external impact is covered on the resistive element 120 printed at a predetermined thickness between the lower electrodes 130.

The protection layer 160 is formed on exposed overall surfaces of the resistive element 120 for the purpose of protecting the resistor 12. However, it is preferable that the protection layer 160 covers not only a part of inside of the lower electrodes 130 provided on the external side of the resistive element 120, but also the resistive element 120, so as to entirely seal the resistive element 120.

The resistive element 120 having the protection layer 160 formed thereon is allowed to implement resistor characteristics by interrupting a current flow through the chip resistor 200. The resistor is required to have an appropriate capacitance value. Further, it is possible to allow the resistive element 120 to have an appropriate capacitance value by a trimming process through a laser, after the protection layer 160 is formed.

After the protection layer 160 covering the resistive element 120 is formed, the leveling electrodes 170 are provided that come into electrical contact with the lower electrodes 130. The leveling electrodes 170 may be formed on a circumstance of the protection layer 160 which covers a part of the lower electrodes 130 and the lower electrodes 130. The leveling electrodes 170 play a role of enabling stable contact between the electrodes by expanding reduced effective areas of the lower electrodes 130.

Meanwhile, the plating layer 180 for formation for the final external electrode is formed on the leveling electrodes 170. The plating layer 180 may be sequentially subjected to Ni plating or Sn plating. The plating layer 180 may be formed through electroless plating or electro plating.

In addition, the chip resistor 200 may further include an insulting layer 190 which entirely covers the protection layer 160, when the external electrode is formed by the plating layer. It is preferable that the insulating layer 190 may be made of a glass material or a polymer material similar to that of the protection layer 160. The insulating layer 190 plays a role of finally protecting the resistive element 120.

In this case, it is preferable that the plating layer 180 formed on both sides of the insulating layer 190 is formed to have a height higher than that of the central portion of the insulating layer 190.

When the chip resistor 200 is mounted on the main substrate, the plating layer 180 and the insulating layer 190 surrounding the lower electrodes 130 and the resistive element 120 come into contact with the main substrate PCB, so that it is possible to prevent the resistive element 120 from being exposed to outside.

Bonding of the chip resistor 200 to the main substrate PCB after mounted is made through soldering. Solders S fused in soldering boding come into contact with the lower electrodes 130 of the chip resistor 200.

In this case, the solders S are not exposed to outside of the chip resistor 200, but the contact area of the lower electrodes 130 extended to edges thereof are expanded. Therefore, it is possible to maintain an enough bonding strength between the main substrate PCB and the chip resistor 200 only through solder bonding.

As such, even if the corners of the top surface of the substrate are scratched when the chip resistor 200 is bonded to the main substrate PCB, it is possible to prevent short between electrodes at soldering.

According to the chip resistors 100 and 200 of the present invention, the resistive element 120 is disposed on the center of the bottom surface of the substrate 110, so that the resistive element 120 can be prevented from being exposed to outside when mounted on the main substrate. Even if external impact is applied to the chip resistors 100 and 200, the resistive element 120 is prevented from being broken. Further, it is possible to maintain inherent resistor characteristics by preventing damage of the resistive element 120.

As described above, according to the chip register of the present invention, since the resistive element is printed inside of the lower electrodes on the bottom surface of the substrate, the resistive element can be prevented from being damaged due to external impact.

Moreover, according to the present invention, side electrodes formed on the side surface of the substrate are extended from the lower electrodes formed on outermost edges of the substrate, so that it is possible to prevent short between electrodes due to scratch at the time of soldering.

Furthermore, according to the present invention, it is possible to minimize a size of side electrodes, or to reduce usage of paste for electrode formation since it is unnecessary to separately form upper electrodes. A plating layer on the bottom surface of the substrate is formed to have a height higher than an insulating layer, thereby stably mounting a chip resistor on a substrate.

As described above, although the preferable embodiments of the present invention have been shown and described, it will be appreciated by those skilled in the art that substitutions, modifications and variations may be made in these embodiments without departing from the principles and spirit of the general inventive concept, the scope of which is defined in the appended claims and their equivalents.

What is claimed is:

1. An array type chip resistor comprising:

a substrate formed in a rectangular parallelepiped shape;

lower electrodes disposed on both sides of a bottom surface of the substrate at equal spaces;

side electrodes extended from some of lower electrodes, formed on outermost edges of both sides of the substrate, in all lower electrodes, to a side surface of the substrate;

a resistive element interposed between lower electrodes of the bottom surface of the substrate;

a protection layer covered on the resistive element, the protection layer having both sides which cover a part of the lower electrodes and the resistive element;

leveling electrodes being in contact with the lower electrodes exposed to outside of the protection layer; and a plating layer formed on the leveling electrodes.

2. The array type chip resistor of claim 1, wherein the substrate is made of alumina material insulated through an anodizing process of aluminum's surface.

3. The array type chip resistor of claim 1, wherein the side electrodes are formed to have heights ranging between 50% to 100% in comparison with a height of the side surface of the substrate.

4. The array type chip resistor of claim 3, wherein the side electrodes are formed of the same material as that of the lower electrodes, simultaneously while the plating layer are being formed.

5. The array type chip resistor of claim 1, wherein:

the protection layer may be made of a silicon material or a glass material, and the protection layer is covered up to a part of inside of the lower electrodes exposed to both sides of the resistive element.

6. The array type chip resistor of claim 1, wherein the leveling electrodes are in contact with effective areas of the lower electrodes and are formed on a circumstance of the protection layer which covers a part of the lower electrodes.

7. The array type chip resistor of claim 1, wherein the plating layer is for formation of an external electrode formed by growing a Ni—Sn plating on the leveling electrodes.

8. The array type chip resistor of claim 1, wherein the chip resistor further comprises an insulating layer which covers outside of the protection layer.

9. The array type chip resistor of claim 8, wherein the insulating layer is formed of glass or polymer.

10. The array type chip resistor of claim 8, wherein the plating layer is formed to have a height higher than that of the insulating layer.

11. An array type chip resistor comprising:

a substrate having a rectangular parallelepiped shape;

lower electrodes disposed on both sides of a bottom surface of the substrate at equal spaces, wherein some of the lower electrodes, which are disposed on corners of the substrate, have larger areas than those of other lower electrodes;

a resistive element disposed between the lower electrodes of the bottom surface of the substrate;

a protection layer covered on the resistive element, both sides of the protection layer covering a part of the lower electrodes and the resistive element;

leveling electrodes being in contact with the lower electrodes exposed to outside of the protection layer; side electrodes are formed to be extended from the lower electrodes to the side surface of the substrate; and a plating layer formed on the leveling electrodes, the plating layer having one side which is extended to be in contact with the corners of the substrate so that the plating layer is opposed to the lower electrodes extended to the corners of the substrate.

12. The array type chip resistor of claim 11, wherein:

the side electrodes are formed to have heights below 20% in comparison with a height of the side surface of the substrate.

13. The array type chip resistor of claim 11, wherein the substrate is made of alumina material insulated through an anodizing process of aluminum's surface.

14. The array type chip resistor of claim 11, the plating layer is for formation of an external electrode formed by growing a Ni—Sn plating on the leveling electrodes.

15. The array type chip resistor of claim 11, wherein the chip resistor further comprises an insulating layer which covers outside of the protection layer.

16. The array type chip resistor of claim 15, wherein the protection layer and the insulating layer are formed of glass or polymer.

17. The array type chip resistor of claim 15, wherein the plating layer is formed to have a height higher than that of the insulating layer.

* * * * *